US007019218B2

(12) United States Patent
Somers et al.

(10) Patent No.: US 7,019,218 B2
(45) Date of Patent: Mar. 28, 2006

(54) UTP CABLE APPARATUS WITH NONCONDUCTING CORE, AND METHOD OF MAKING SAME

(75) Inventors: Steve L. Somers, Chino Hills, CA (US); Ash Raheja, Foothill Ranch, CA (US); Jacob Geil, Irvine, CA (US)

(73) Assignee: RGB Systems, Inc., Anaheim, CA (US)

( * ) Notice: Subject to any disclaimer, the term of this patent is extended or adjusted under 35 U.S.C. 154(b) by 0 days.

(21) Appl. No.: 10/922,223

(22) Filed: Aug. 18, 2004

(65) Prior Publication Data

US 2005/0045367 A1 Mar. 3, 2005

Related U.S. Application Data

(63) Continuation-in-part of application No. 10/800,275, filed on Mar. 12, 2004, and a continuation-in-part of application No. 10/439,365, filed on May 16, 2003.

(60) Provisional application No. 60/496,244, filed on Aug. 19, 2003, provisional application No. 60/418,864, filed on Oct. 16, 2002.

(51) Int. Cl.
*H01B 7/00* (2006.01)

(52) U.S. Cl. ..... 174/113 R; 174/113 C

(58) Field of Classification Search ..... 174/110 R, 174/110 PM, 110 N, 113 R, 113 C, 120 R, 174/120 C
See application file for complete search history.

(56) References Cited

U.S. PATENT DOCUMENTS

| | | | | |
|---|---|---|---|---|
| 3,546,357 | A * | 12/1970 | Windeler et al. | 174/34 |
| 4,381,426 | A * | 4/1983 | Cronkite et al. | 174/117 F |
| 4,408,443 | A * | 10/1983 | Brown et al. | 57/204 |
| 4,486,619 | A * | 12/1984 | Trine et al. | 174/34 |
| 5,162,609 | A * | 11/1992 | Adriaenssens et al. | 174/34 |
| 5,298,680 | A * | 3/1994 | Kenny | 174/36 |
| 5,493,071 | A * | 2/1996 | Newmoyer | 174/113 R |
| 5,767,441 | A * | 6/1998 | Brorein et al. | 174/27 |
| 5,789,711 | A * | 8/1998 | Gaeris et al. | 174/113 C |
| 5,969,295 | A * | 10/1999 | Boucino et al. | 174/113 C |
| 6,215,071 | B1 * | 4/2001 | Kasahara et al. | 174/117 F |
| 6,248,954 | B1 * | 6/2001 | Clark et al. | 174/113 R |
| 6,348,651 | B1 * | 2/2002 | Chou et al. | 174/27 |
| 6,355,876 | B1 * | 3/2002 | Morimoto | 174/27 |
| 6,452,094 | B1 * | 9/2002 | Donner et al. | 174/27 |
| 6,787,694 | B1 * | 9/2004 | Vexler et al. | 174/27 |
| 6,818,832 | B1 * | 11/2004 | Hopkinson et al. | 174/113 R |
| 2003/0150638 | A1 * | 8/2003 | Patel | 174/113 R |
| 2003/0205402 | A1 * | 11/2003 | Koyasu et al. | 174/113 C |

* cited by examiner

*Primary Examiner*—William H. Mayo, III
(74) *Attorney, Agent, or Firm*—The Hecker Law Group, PLC

(57) ABSTRACT

An unshielded twisted pair (UTP) cable having a common electrical length among twisted pairs that carry analog signals and a different lay length and lay direction to a twisted pair that carries digital signal to minimize cross-talk from the digital signal onto the analog signals is presented. A non-conductive filler provides a central core about which the twisted pairs are wound during the bundling process and thus ensures that a minimum distance (i.e., the diameter of the core) is maintained between non-adjacent pairs of conductors for the length of the cable.

20 Claims, 5 Drawing Sheets

UTP CABLE APPARATUS WITH NONCONDUCTING CORE, AND METHOD OF MAKING SAME

CROSS-REFERENCES TO RELATED APPLICATIONS

This application claims the benefit of priority from U.S. Provisional Patent Application Ser. No. 60/496,244, filed on Aug. 19, 2003; is a continuation-in-part of U.S. patent application Ser. No. 10/439,365, filed on May 16, 2003, which claims priority from U.S. Provisional Patent Application Ser. No. 60/418,864, filed on Oct. 16, 2002; and is a continuation-in-part of U.S. patent application Ser. No. 10/800,275, filed on Mar. 12, 2004, all of the specifications and figures of which are herein incorporated by reference.

BACKGROUND OF THE INVENTION

1. Field of the Invention

This invention relates to the field of electronic cable equipment, and more specifically, to cables used for the concurrent transmission of analog and digital signals, such as for analog video and digital audio.

2. Background Art

Data networks, or LANs, typically use low cost UTP (unshielded twisted pair) cables for bi-directional communication of digital data. In addition, UTP may be used to convey analog video signals over a dedicated video-type network. In both cases, the current constructions of UTP wherein four twisted pairs are utilized, involve manipulation of the twisted pairs such that each pair has a different lay length (i.e., the length of a single twist interval) throughout the cable so as to minimize cross-talk of data signals between pairs. Various lay lengths are combined such that coupling is minimized.

FIGS. 1A and 1B illustrate the construction of a prior art Unshielded Twisted Pair (UTP) cable for data transmission. As illustrated in FIG. 1A, a typical UTP cable 100 comprises four twisted pair wires 104, 106, 108, and 110, all located within a cable bundle. The bundled twisted pair wires are held together with insulation layer 102. Referring to FIG. 1B, each of the four twisted pairs (e.g. 104, 106, 108 or 110) consists of two wires identified with suffix "A" and "B" and having a specific lay length. For instance, twisted pair 104 comprises wire 104A and wire 104B having a constant lay length "A" throughout its length; twisted pair 106 comprises wire 106A and wire 106B having a constant lay length "B" throughout its length; twisted pair 108 comprises wire 108A and wire 108B having a constant lay length "C" throughout its length; and twisted pair 110 comprises wire 110A and wire 110B having a constant lay length "D" throughout its length.

As illustrated, each of the prior art twisted pair cables (e.g. 104, 106, 108, or 110) has a specific lay length different from the other twisted pairs. All of these twisted pairs, each one made with a specific lay length, are located side-by-side within a cable bundle. The different lay lengths contribute to reduced crosstalk.

In the application of analog video, including RGB analog video or graphics, UTP data cables may be utilized. Implementations suffer from the fact that the data cable construction having different lay lengths between conducting pairs results in each pair having a different electrical length. The differing electrical lengths result in proportional delay of the video signal when applied over the long distances (around 100 meters or more) typically encountered in this type of application.

The different electrical lengths result in a relative delay between RGB signals in an RGB analog video implementation, for example. The delay period is long enough to create an offset of visual information on the display screen so as to appear misconverged. Graphics details will not properly line up on the screen at the appropriate location. This "fringing effect" makes for poor quality or totally unacceptable video performance. To counteract this affect, some form of delay must be added to the shorter pathways in the transmission line to equalize the delays such that the longest delay becomes the standard by which the others are adjusted. Various methodologies for accomplishing this are known. For example, an appropriate length of cable may be added to each of the faster transmission lines to compensate. In addition, various electrical circuit schemes exist for delaying video channels within the processing system that receives the UTP-transmitted information and converts it to usable analog content.

The above scenario describes results based on use of three of the four available twisted pairs within the bundle. The three active pairs are conveying red, green, and blue signals, respectively. The fourth pair of the bundle may or may not be used. In cases where the fourth pair is used, it may carry digital control and/or audio channels. For example, stereo audio may be digitized and packetized for transmission over the fourth pair, allowing for simultaneous distribution of stereo audio along with RGB analog video or computer graphics. The intimacy of this fourth pair with the other three carrying video information can cause significant signal coupling, or crosstalk, wherein the digital signal induces noise into any or all of the three video-carrying pairs. This crosstalk may take many forms. Among those forms may be high frequency random noise effects (sometimes called "popcorn noise") or differentiated signal edges induced into the analog video information and erroneously interpreted by the target display device as normal synchronization pulses. This latter condition may falsely trigger the display, which typically causes the display to blank the display screen.

Extron recognized a need to correct for these problems by manufacturing a low-skew UTP cable. In the low-skew cable, the lay lengths of the twisted pairs are equal in length. Equal lay lengths on the pairs mean that the electrical lengths are very nearly equal. The time difference becomes so small that it is, for all practical purposes, negligible. Furthermore, the twisted pairs are bundled together utilizing the standard twist-lay process used for such a cable. This is a departure for UTP-type data networks because the equal length pairs will promote close coupling of digital data and not be suitable for data networks.

In analog video and graphics application, the cross coupling is not a prime issue. The cross coupling is small enough that the receiver can be equalized to mostly ignore it since the analog video system is a one-way transmission application. However, when digital control signals and/or digital audio channels are conveyed over the fourth pair in these applications, noise is often induced into one or more of the video-carrying pairs. Additionally, the signaling voltage on the typical analog RGB or video system is not compliant with voltages used for data networks. This means that UTP cabling that might be used for data networks must be wholly dedicated to the analog video application and cannot be shared. Applying the typical analog video connection to a UTP within a data network will not only be format incompatible, it will likely damage network components.

Utilization of the low-skew UTP cable is appropriate for dedicated installations where prior knowledge of the analog video/graphics system is prescribed. Clearly, this cable will be dedicated to the analog "network" and not used for data. Likewise, the data network could use the cable but will likely not use it because key crosstalk parameters important to data network communications will be severely compromised such that the data network node may not perform at all.

Therefore, there is a need for a cable that can satisfy the low skew requirements of video signaling, while providing sufficient cross-talk isolation so that digital information simultaneously conveyed through the cable does not significantly impair the quality of the video signals.

SUMMARY OF THE INVENTION

The present invention provides a cable apparatus for minimizing skew delay of analog signals and cross-talk from digital signals, and method of making same. In an embodiment of the invention, the cable comprises multiple unshielded twisted pairs (UTP) of conductors that can accommodate the transmission of multiple analog signals, such as for analog video, and one or more digital signals, such as for digital control and/or audio. The twisted pairs used to transmit analog signals may be of substantially uniform electrical length to minimize skew, and may also be twisted in the same lay direction (i.e., clock-wise or counter-clockwise).

To minimize cross-talk between the pair(s) carrying digital signal(s) and the pairs carrying analog signals, the twisted pair or pairs used to transmit digital signals may be twisted in the opposite lay direction with respect to the analog pairs, and may have a lay length that differs from any lay length used in the twisting of the analog pairs. In embodiments providing multiple pairs for digital transmission, the lay lengths and the lay directions of those pairs may also differ from one another.

In one or more embodiments, a nonconductive filler material is used to provide a central core about which the twisted pairs are positioned during the outer jacket extrusion process. The presence of the nonconductive filler ensures that a minimum distance (i.e., the diameter of the filler) is maintained between adjacent and non-adjacent pairs for the length of the cable. Signal quality is improved due to the reduction in crosstalk between adjacent and nonadjacent pairs.

DETAILED DESCRIPTION

A cable apparatus for minimizing skew delay of analog signals and cross-talk from digital signals, and method of making same are described. In the following description, numerous specific details are set forth to provide a more thorough description of the present invention. It will be apparent, however, to one skilled in the art, that the present invention may be practiced without these specific details. In other instances, well known features have not been described in detail so as not to obscure the present invention.

Embodiments of the invention may be constructed in a manner that provides for a group of twisted pairs having the group characteristic of low skew, while one or more additional twisted pairs have the characteristic of reduced crosstalk with respect to the first group of twisted pairs and each other. For purposes of example, an embodiment suited to analog video applications will be described. Specifically, in this embodiment, a group of three twisted pairs of conductors is constructed with minimal skew for the purposes of transmitting three analog color video channels, e.g., a red (R) channel, a green (G) channel and a blue (B) channel. A fourth twisted pair of conductors is constructed to provide reduced crosstalk with respect to the other pairs. This fourth pair may be used in the video application for the transmission of a digital (or analog) audio signal or a digital control signal, for example. A nonconductive filler strand may be imposed along the longitudinal axis of the cable to enhance spacing control among the pairs of conductors.

The structural features and method of construction associated with this four-pair embodiment may be similarly applied in other embodiments having more or fewer pairs with minimal skew, as well as more pairs with minimized crosstalk.

Figure 1A:
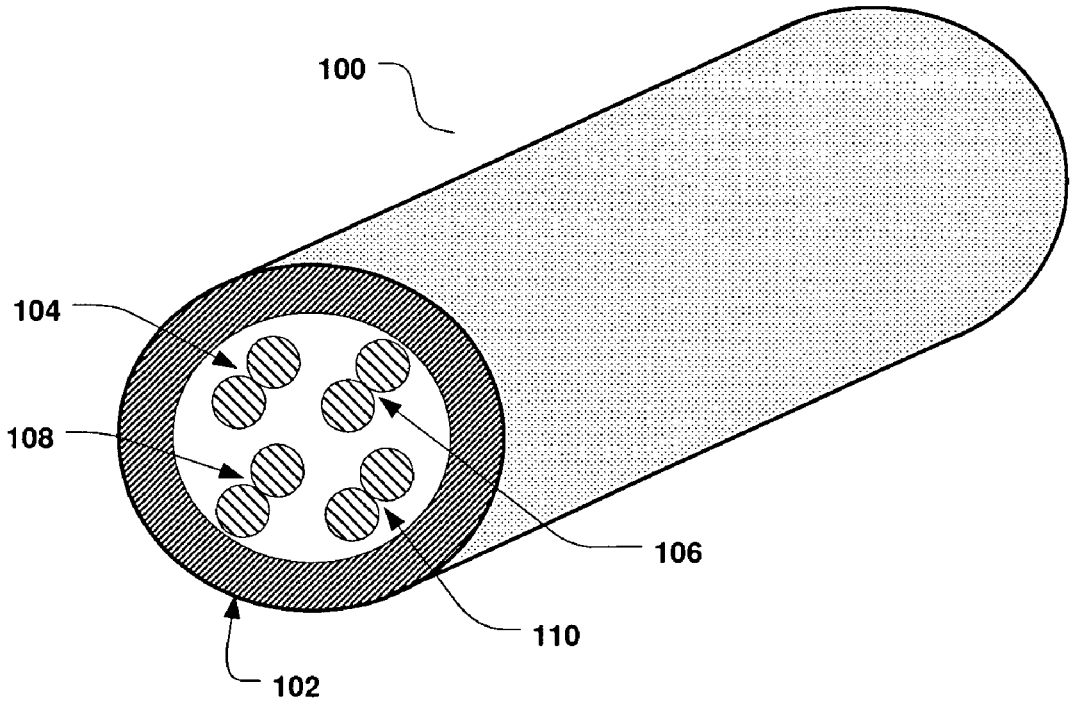
FIGURE 1A (Prior Art)
FIGS. 1A and 1B show a typical example of a UTP cable of the prior art.
Figure 1B:
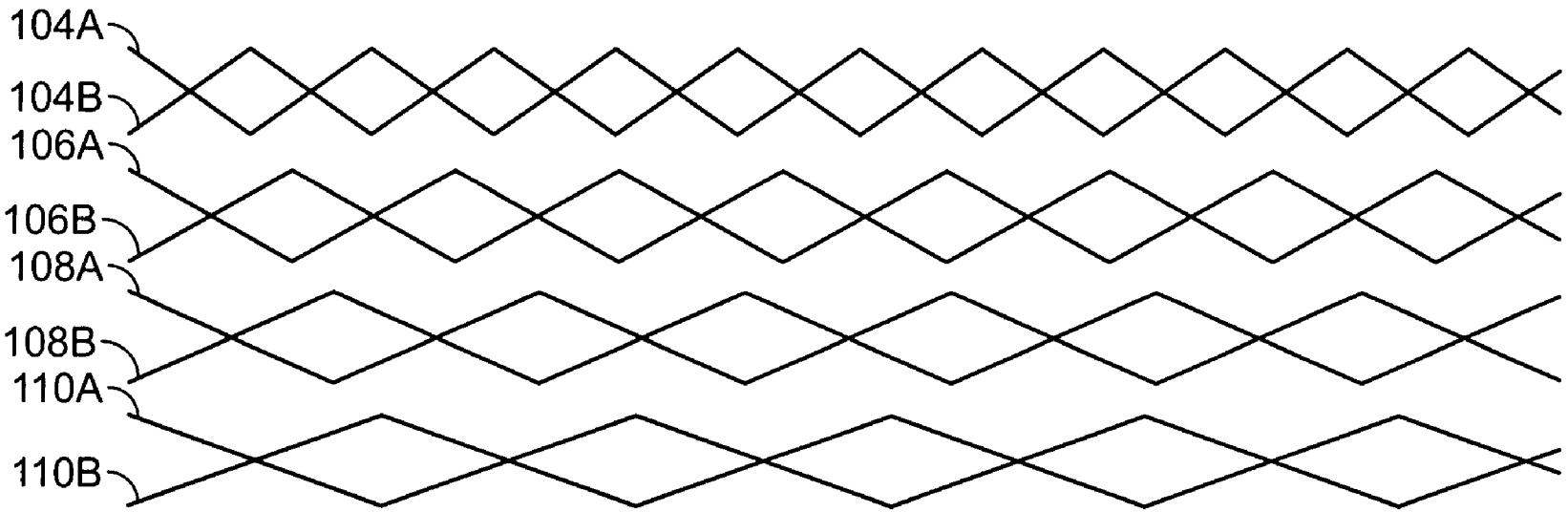
FIG. 1B (Prior Art)
Figure 2:
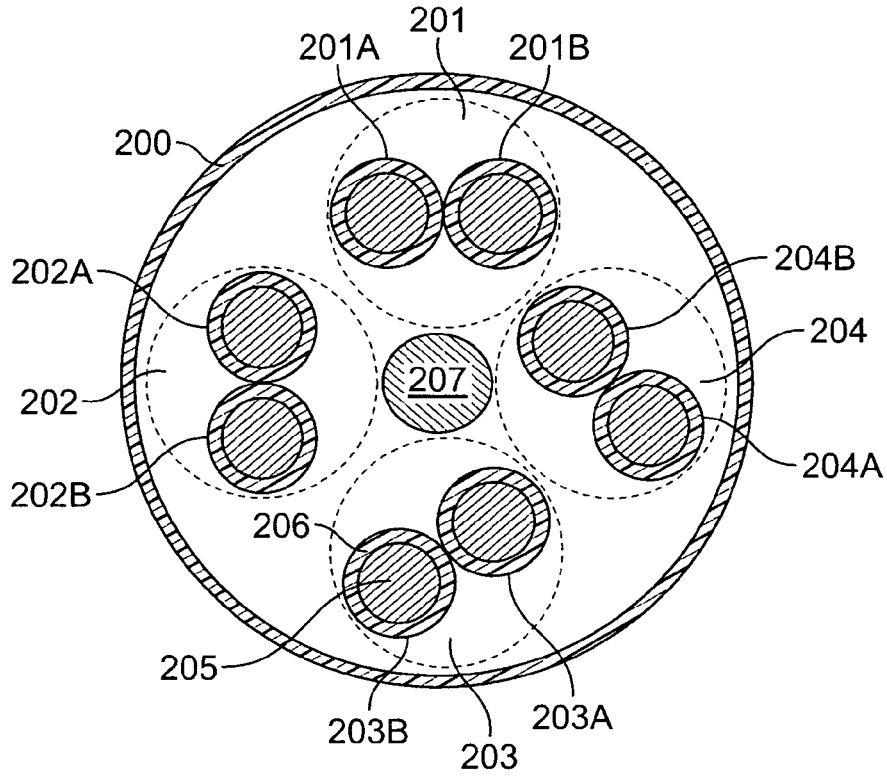
FIG. 2 is a cross-sectional view of a UTP cable in accordance with an embodiment of the invention.

FIG. 2 is a cross-sectional view of a UTP cable in accordance with an embodiment of the invention. The UTP cable comprises twisted pairs 201–204 surrounded by an outer protective jacket or sleeve 200. Each twisted pair contains a pair of wires (e.g., 201A and 201B), each of which comprises an inner conductor 205 in an insulating sleeve 206. The dashed circles around each twisted pair represent the cross-sectional area occupied within the cable by the twisting of each pair. An inner core 207 of insulating filler material acts as a center spacer between twisted pairs 201–204.

Inner conductor 205 may be formed of, for example, copper or some other conducting material. Insulating sleeve 206 may be formed of, for example, polyolefin or some other flexible material with insulating properties. The insulation 206 may be color coded or otherwise marked to identify respective pairs and individual wires within each pair. The outer jacket 200 may be formed of, for example, extruded PVC (polyvinyl chloride) material.

Various non-conducting materials may be used to form the filler, such as Nylon or Polyethylene resin or other flexible insulator. The choice of filler material may be made to fulfill or enhance desirable structural characteristics of the cable, such as rigidity/flexibility and tensile strength. For example, a stiffer cable may be provided by using a filler material with a more rigid structure. The filler may also consist of a combination of materials, e.g., in a layered core or entwined structure. The filler material may also have alternative channeling capabilities. For example, the filler material may have fiber optic qualities, offering a further high-speed optical channel to the cable structure, or the filler may be a hollow structure through which a gas or liquid could pass for pneumatic or hydraulic functions.

Figure 3:
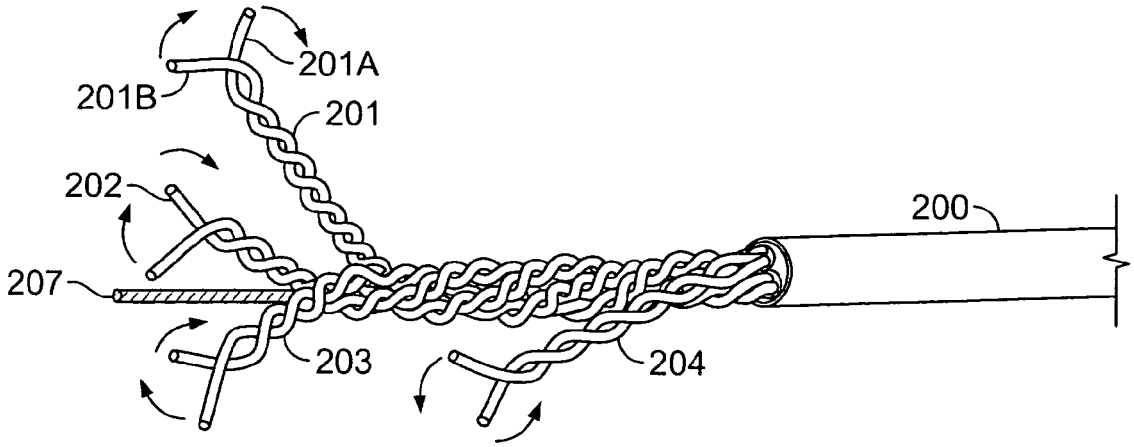
FIG. 3 is a cut-away view of a UTP cable in accordance with an embodiment of the invention.

FIG. 3 is a cut-away view of a UTP cable constructed in accordance with an embodiment of the invention. In FIG. 3, the different lay (or twist) directions within the UTP cable are made apparent. In the illustrated embodiment, twisted pairs 201, 202 and 203 are individually twisted in a first lay direction (e.g., clockwise). Twisted pair 204 is twisted in the opposite lay direction (e.g., counterclockwise), and laid in parallel with pairs 201–203. In one or more embodiments, pairs 201–204 are twisted around core 207. The pairs may be twisted in the same direction around core 207, or, alternatively, one or more of the pairs may be wrapped in an opposite direction, e.g., pair 204 may be wrapped around core 207 in an opposite direction to that in which pairs 201–203 are wrapped around core 207. In yet another embodiment, pairs 201–203 may be wrapped around core 207 as a bundle, while pair 204 is laid in parallel with the bundle during jacket extrusion.

While FIG. 3 is not drawn to scale, the lay length of twisted pair 204 can be seen to be longer (i.e., has a lower twist rate) than the common lay length of twisted pairs 201–203. The differences in lay length are more clearly illustrated in FIGS. 4A and 4B.

Figure 4A:
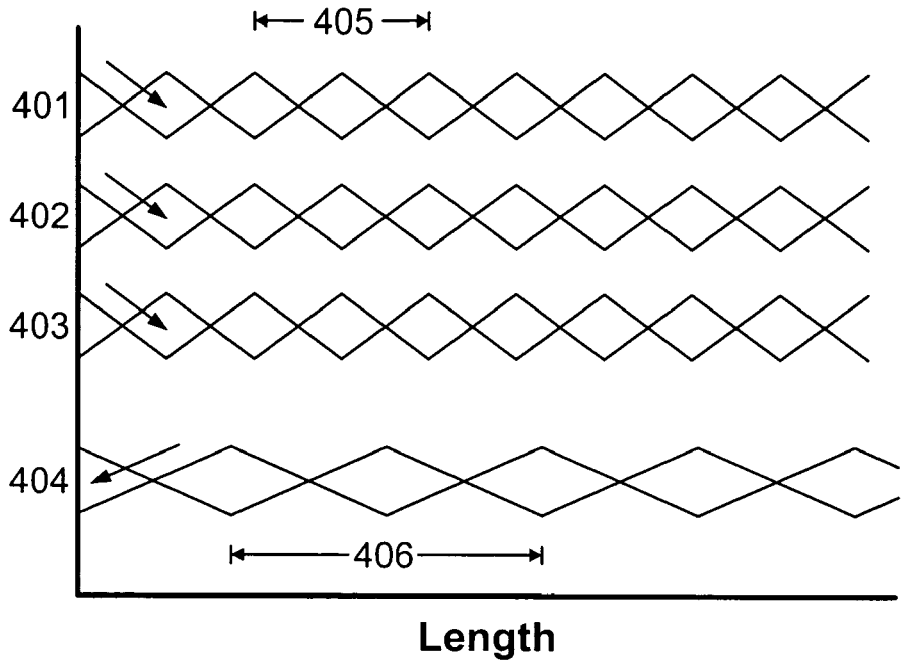
FIGS. 4A and 4B are flattened views of a four-pair UTP cable in accordance with embodiments of the invention.

FIG. 4A is a flattened representation of the twisted pairs in accordance with one embodiment of the invention. In this embodiment, twisted pairs 401, 402 and 403 have the same lay length 405 and the same lay direction (represented by the arrows pointing to the right). Although twisted pairs 401, 402 and 403 are shown here with the same twisting phase (i.e., the twist "peaks" line up with each other), such an alignment is not required.

Twisted pair 404 is illustrated with lay length 406 that is longer (i.e., has a lower twist rate) than that of twisted pairs 401–403 (i.e., lay length 405). Also, the lay direction (represented by the arrow pointing to the left) of twisted pair 404 is preferably opposite to that of twisted pairs 401–403.

Figure 4B:
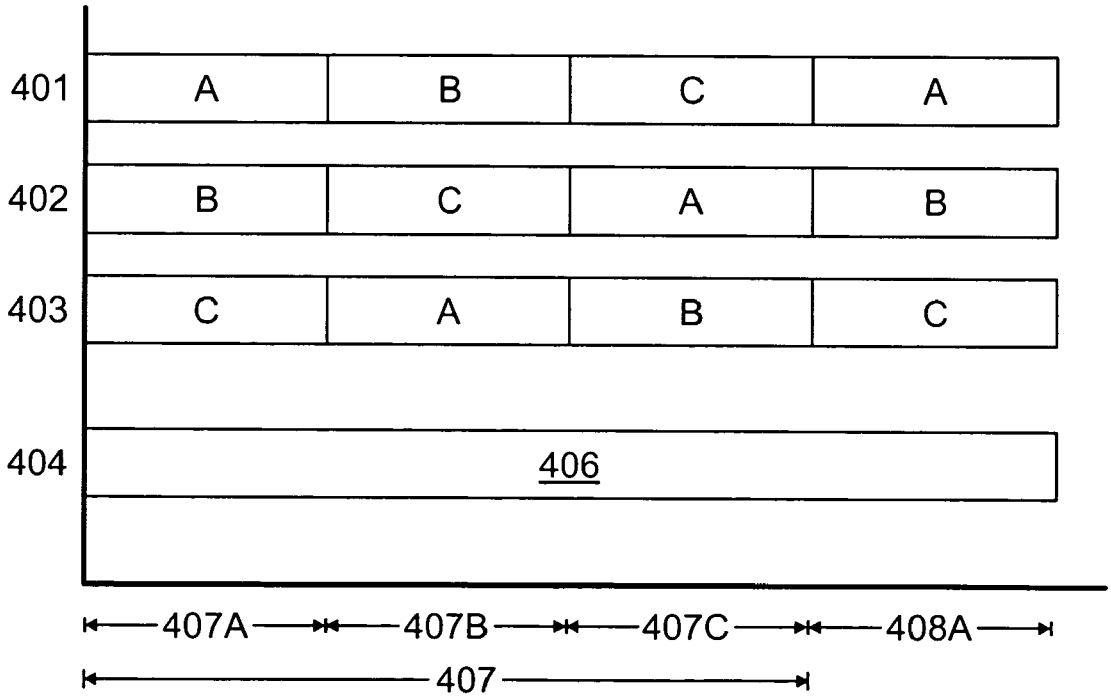

FIG. 4B illustrates an application of twist rates in accordance with an embodiment of the invention, in which twisted pairs 401–403 use multiple lay lengths, while maintaining substantially equivalent electrical lengths. As shown, during subinterval 407A, twisted pair 401 has lay length A, twisted pair 402 has lay length B, and twisted pair 403 has lay length C. During subinterval 407B, twisted pair 401 has lay length B, twisted pair 402 has lay length C, and twisted pair 403 has lay length A. During subinterval 407C, twisted pair 401 has lay length C, twisted pair 402 has lay length A, and twisted pair 403 has lay length B. Subinterval 408A repeats the lay length assignment of subinterval 407A, and so on. Twisted pair 404 is illustrated with lay length 406 throughout, which is preferably different than any of lay lengths A, B or C. (In embodiments with multiple additional pairs like twisted pair 404, those additional pairs may also implement a staggered or varying lay length arrangement.)

The electrical lengths of twisted pairs 401, 402 and 403 are unequal during any of the single distance subintervals illustrated (e.g., 407A, 407B, etc.) due to the different lay lengths implemented for each pair. However, over the complete distance interval 407, the lay length assignments complete a cycle in which each pair has applied each lay length for an approximately equivalent distance, thus providing equivalent electrical lengths over the complete interval.

The use of staggered lay length assignments in this embodiment improves cross-talk rejection between twisted pairs 401, 402 and 403. Further, by cutting the resulting cable into segments approximately equal to distance interval 407 or integer multiples thereof, the cable segments will have substantially equivalent electrical lengths within the group including pairs 401–403, satisfying the objective of minimized skew. For long lengths of cable, even if the cable is cut in the midst of an interval 407, the difference in electrical length between pairs 401–403 will be limited to the difference in electrical length within that last fraction of an interval. This is because the difference in electrical length of wires 401–403 over each of the completed intervals is substantially zero (subject to manufacturing tolerances), yielding a relatively negligible net difference in electrical length.

Figure 5:
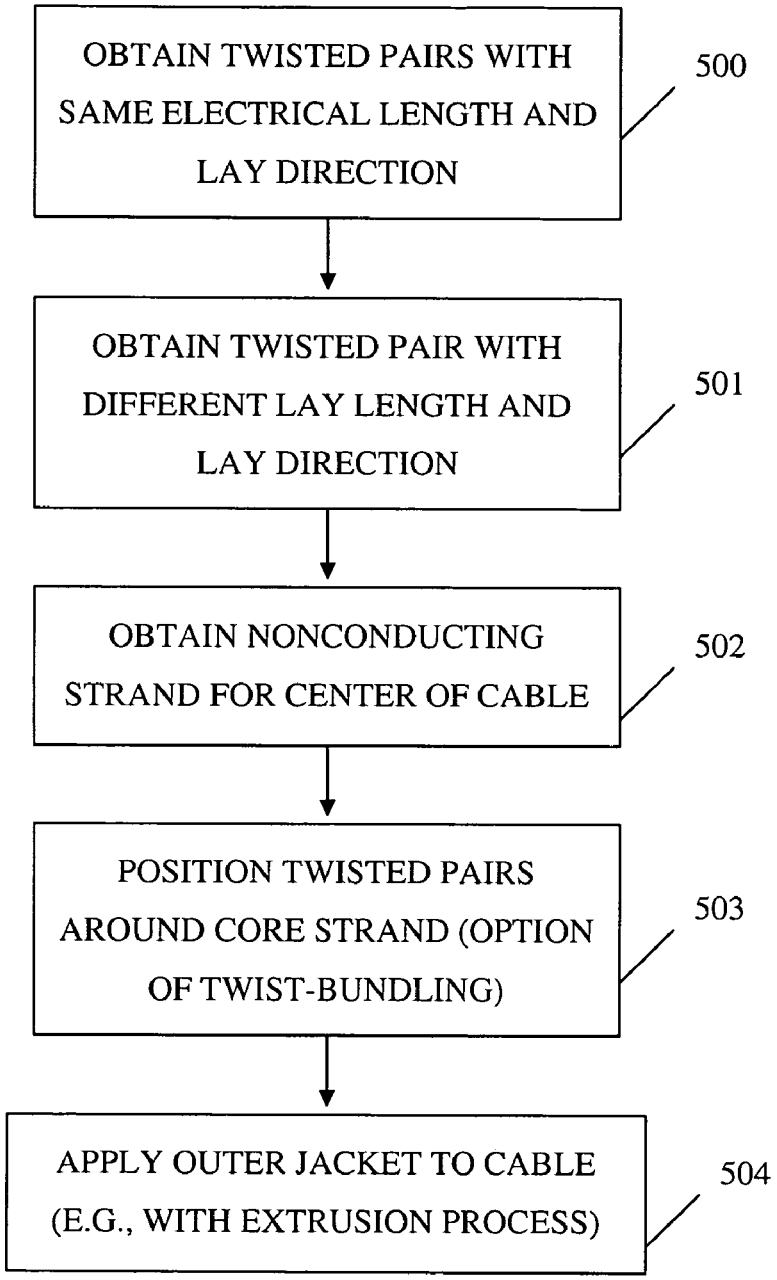
FIG. 5 is a flow diagram of a process for making a UTP cable in accordance with an embodiment of the invention.

FIG. 5 is a flow diagram of a process for constructing a UTP cable, in accordance with one embodiment of the invention. In block 500, a group of twisted-pair conductors are obtained with substantially equivalent electrical lengths to convey information without the need for special time delay skew compensation. For the purposes of this description, substantial equivalence in electrical length means that the maximum difference in electrical length between any two twisted pairs is within a specified tolerance range. This specified tolerance range may vary for different applications, depending on the level of signal synchronization needed. For example, the tolerance range in a standard color video application might be at or around 0.5 inches in one embodiment.

The twisted pairs in this group may have a uniform lay length, or they may use a staggered arrangement of different lay lengths in which the overall electrical length within the group is uniform. This uniformity of electrical length provides the minimized skew characteristic desired in, for example, analog video applications. Preferably, the lay direction is the same for each twisted pair in the group.

In block 501, one or more additional twisted pairs are obtained that have a different lay length than the individual pairs in the first group. Preferably, the lay length(s) of the additional twisted pairs are longer than, and not an integer multiple of, the lay length(s) within the first group. For multiple additional pairs, their respective lay lengths may also differ from one another, at least in adjoining sections. For greater cross-talk rejection with respect to the first group of pairs, the additional pair(s) may have a lay direction that is opposite to that of the pairs in the first group.

In block 502, a strand of nonconducting material is obtained for use as the core of the cable. As previously described, the strand may comprise a single nonconducting material or a combination of materials. Further, the strand may be designed to provide an additional channel, such as a fiber optic channel for optical signaling, or a hollow inner bore containing gas or fluid for pneumatic, hydraulic or thermal functions. In one or more embodiments, the strand can be designed to balance the opposing goals of maximizing the minimum distance between adjacent and non-adjacent pairs in the cable and minimizing the overall width of the cable. Different strand widths may be suitable for different cable applications.

In block 503, the twisted pairs may be twist-bundled together as a group around the nonconducting strand. This bundling can help to strengthen the cable, simplify the final jacketing process, and further enhance cross-talk rejection with respect to any pairs that are not intimately bundled with the group (e.g., the pair for digital signaling). In other embodiments, the twisted pairs may be lined up alongside the core strand, preferably evenly spaced around the circumference of the strand (e.g., one pair every 90 degrees), in preparation for the jacket extrusion process.

In block 504, the outer insulator jacket is applied, e.g., by feeding the twisted pairs and core strand through an extruder. In embodiments including twisted pairs staggered sections of differing lay lengths, uniformity of the electrical lengths in the group may be optimized at intervals along the cable (e.g., where the staggered lay-length pattern repeats). Those intervals may be marked on the outside of the cable jacket to facilitate cutting lengths of cable that will provide optimum performance.

The result of the process illustrated in FIG. 5 is a UTP cable having a group of pairs with minimal skew between them and significant cross-talk rejection with respect to one or more additional pairs. The cable can also exhibit greater strength and reliability as well, due to the core material bearing physical stresses normally experienced by the wire conductors.

Thus, a cable apparatus for minimizing skew delay of analog signals and cross-talk from digital signals, and method of making same, have been described. Particular embodiments described herein are illustrative only and should not limit the present invention thereby. The invention is defined by the claims and their full scope of equivalents.

What is claimed is:

1. A cable comprising:

a plurality of first twisted pairs of conductors having a first lay direction and a first lay length;

a second twisted pair of conductors having a second lay direction and a second lay length, wherein said second lay direction is opposite to said first lay direction and wherein said second lay length is different than said first lay length;

a nonconductive core about which said plurality of first twisted pairs and said second twisted pair are twisted in a bundle; and an outer sleeve encompassing said bundle.

2. The cable of claim 1, wherein said second lay length is longer than said first lay length.

3. The cable of claim 1, wherein said first lay direction is clockwise and said second lay direction is counterclockwise.

4. The cable of claim 1, wherein said first lay direction is counterclockwise and said second lay direction is clockwise.

5. The cable of claim 1, wherein said plurality of first twisted pairs are of substantially equivalent electrical length.

6. The cable of claim 5, wherein said plurality of first twisted pairs have a plurality of lay lengths applied sequentially over equivalent intervals.

7. The cable of claim 1, wherein said nonconductive core comprises Nylon.

8. The cable of claim 1, wherein said nonconductive core comprises Polyethylene resin.

9. The cable of claim 1, wherein said nonconductive core has a hollow bore.

10. A UTP cable comprising:

a plurality of twisted pairs comprising:

three twisted pairs having at least one common lay length and a common lay direction;

a fourth twisted pair having a lay length different from said common lay length and a lay direction opposite to said common lay direction; and a core providing a longitudinal axis about which said plurality of twisted pairs are positioned, said core comprising a nonconductive material.

11. The cable of claim 10, further comprising an outer jacket encompassing said plurality of twisted pairs and said core.

12. The cable of claim 10, wherein said plurality of twisted pairs are twist-bundled around said core.

13. The cable of claim 10, wherein said three twisted pairs are each formed with a plurality of common lay lengths sequentially applied over equivalent intervals.

14. The cable of claim 10, wherein said nonconductive core comprises Nylon.

15. The cable of claim 10, wherein said nonconductive core comprises Polyethylene resin.

16. A method for making a cable comprising:

obtaining a plurality of twisted pairs having a common lay direction and a common lay length;

obtaining at least one additional twisted pair having a lay direction opposite to said common lay direction and a lay length that differs from said common lay length;

positioning said plurality of twisted pairs and said additional twisted pair around a nonconductive core to form a bundle; and encompassing said bundle in an outer jacket.

17. The method of claim 16, wherein obtaining said plurality of twisted pairs comprises sequentially applying a plurality of lay lengths to a pair of conductors, said plurality of lay lengths being applied over equivalent intervals.

18. The method of claim 16, wherein obtaining said at least one additional twisted pair comprises applying a longer lay length than said common lay length.

19. The method of claim 16, wherein obtaining said plurality of twisted pairs comprises obtaining three twisted pairs.

20. The method of claim 16, wherein positioning comprises twisting said plurality of twisted pairs and said additional twisted pair around said nonconductive core.

* * * * *